US005474459A

United States Patent [19]

Su

[11] Patent Number: 5,474,459

[45] Date of Patent: Dec. 12, 1995

[54] INNER PLUG CORE OF A MOLDED POWER PLUG

[76] Inventor: Tun L. Su, No. 90, Chung Chen Road, Lu-Chu Town, Kaohsiung County, Taiwan

[21] Appl. No.: 263,955

[22] Filed: Jun. 14, 1994

[51] Int. Cl.[6] ..... H01R 13/504

[52] U.S. Cl. ..... 439/106; 439/695

[58] Field of Search ..... 439/106, 606, 439/686, 695, 736

[56] References Cited

U.S. PATENT DOCUMENTS 3,611,257 10/1971 Carkhuff ..... 439/606

5,282,753 2/1994 Su ..... 439/106

*Primary Examiner*—Gary F. Paumen

*Attorney, Agent, or Firm*—Morton J. Rosenberg; David I. Klein

[57] ABSTRACT

An inner plug core of a power plug is provided. The inner plug core includes a main body which is formed with an upper insert hole, a lower left insert hole and a lower right insert hole located substantially at three corners of a triangle defined thereby. A C-shaped tongue member is disposed under the upper insert hole and extends toward a front side of the inner plug core. The tongue member has a bottom transverse plate connected to the main body of the inner plug core by a reinforcing triangular support plate. The tongue member further has a top transverse plate on which an elliptic boss is disposed for receipt within a corresponding elliptic hole formed in a grounding terminal. The top transverse plate of the tongue member is cantilevered to serve as a force arm. Thus, only a light force is needed to press down the transverse plate of the tongue member, permitting the grounding terminal to be easily inserted into the upper insert hole. The lower left and lower right insert holes of the inner plug core are separated by a reverse E-shaped member having a central support rod and two lateral plates. Each lateral plate has an outwardly extending inclined guide plate which facilitates the insertion of a positive and a negative terminal into the inner plug core.

1 Claim, 4 Drawing Sheets

INNER PLUG CORE OF A MOLDED POWER PLUG

BACKGROUND OF THE INVENTION

1. Field of the Invention

The present invention relates to an improved inner structure of a power plug.

2. Prior Art

A conventional power plug is shown in FIG. 6. Such plug includes an inner plug core 6 formed with an upper arched concave surface 61. Projection 62 is disposed on the arched concave surface 61. The projection 62 is received within a hole 31 formed at a rear end of a circular grounding terminal 3. On each lateral side of the inner plug core 6 are disposed projections 63 which are received within respective recesses 41, 51 formed at rear ends of positive and negative terminals 4 and 5.

The inner plug core 6 secures the grounding terminal 3 and positive and negative terminals 4 and 5 in position when the inner plug core 6 is inserted in a protective cover 7. The protective cover 7 encloses the grounding terminal 3 and positive and negative terminals 4 and 5. Two channels 64 are formed on a bottom surface of the inner plug core 6 for respective receipt of two inner flanges 71 of the protective cover 7 to couple the protective cover 7 in overlaying relationship with the inner plug core 6. The inner plug core 6 and its associated protective cover 7 are shown in FIG. 7. Such is wrapped by a plastic material and formed into the generally used triple-pole power plug, like that shown in FIG. 5.

It is known from the structure of the above inner plug core that manufacturing of the power plug is costly in both time and labor. In addition, the requirement for the protective cover 7 increases the manufacturing cost and reduces production efficiency.

SUMMARY OF THE INVENTION

It is therefore a primary object of the present invention to provide an improved inner plug core of a power plug which eliminates the above shortcomings. The improved inner plug core of the present invention is easily manufactured at a reduced cost.

The present invention can be best understood through the following description and accompanying drawings, wherein.

DETAILED DESCRIPTION OF THE PREFERRED EMBODIMENT

Figure 1:
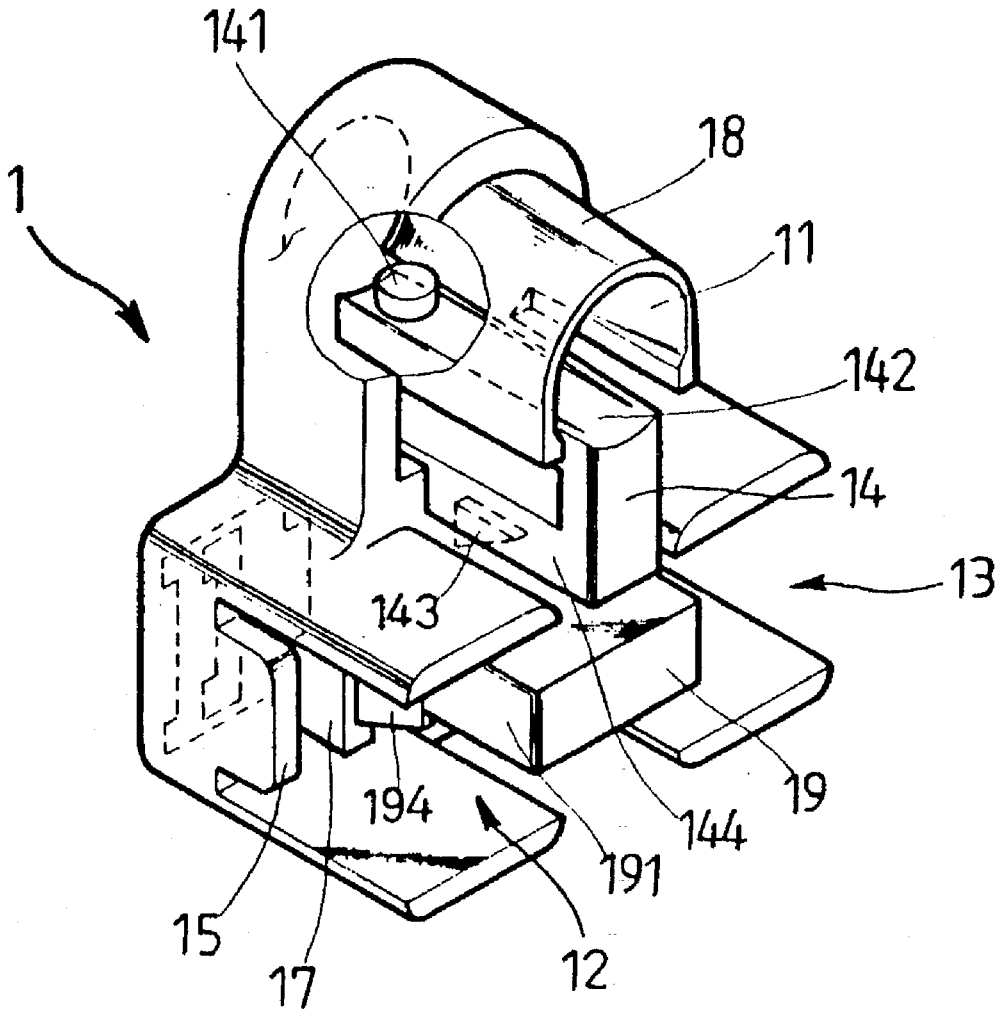
FIG. 1 is a perspective view of the present invention.
Figure 3:
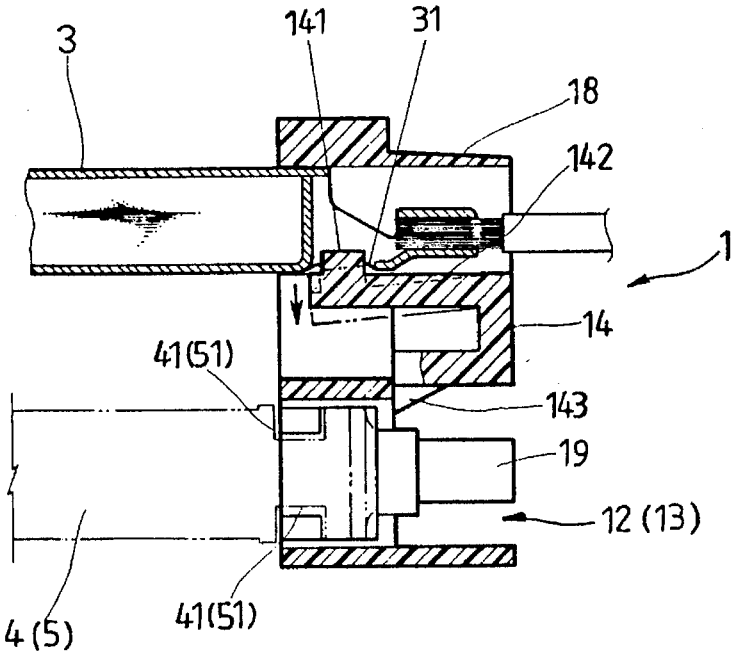
FIG. 3 is a sectional view taken along line 3—3 of FIG. 2.

Please refer to FIGS. 1 and 3. The inner plug core 1 of the power plug of the present invention is substantially T-shaped and is integrally formed by injection molding. An upper insert hole 11, a lower left insert hole 12 and a lower right insert hole 13 are respectively formed in the inner plug core 1 in spaced relationship each from the other. The three insert holes 11, 12 and 13 are respectively located substantially at the three corners of a triangle defined thereby, for respectively receiving a grounding terminal 3, a positive terminal 4 and negative terminal 5 therein.

A protective shade 18 is disposed above the upper insert hole 11 and a C-shaped tongue member 14 is disposed under the protective shade 18 and extends toward a front side of the inner plug core 1. The tongue member 14 has a bottom transverse plate 144 connected with the main body of the inner plug core 1 by a triangular support plate 143 which reinforces the tongue member 14. The tongue member 14 further has a top transverse plate 142 on which an elliptic boss 141 is disposed for receipt into an elliptic hole 31 formed at a rear end of the grounding terminal 3 when the same is inserted into the insert hole 11 of the inner plug core 1.

Figure 2:
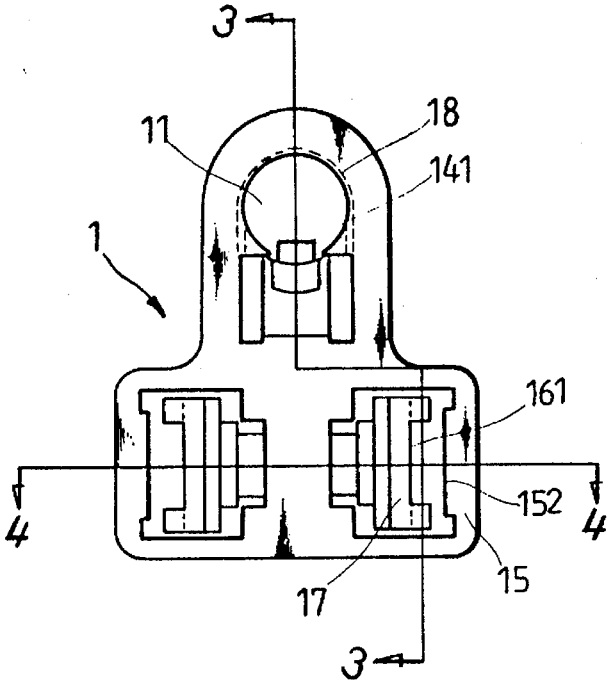
FIG. 2 is a rear elevation view of the present invention shown in FIG. 1.
Figure 4:
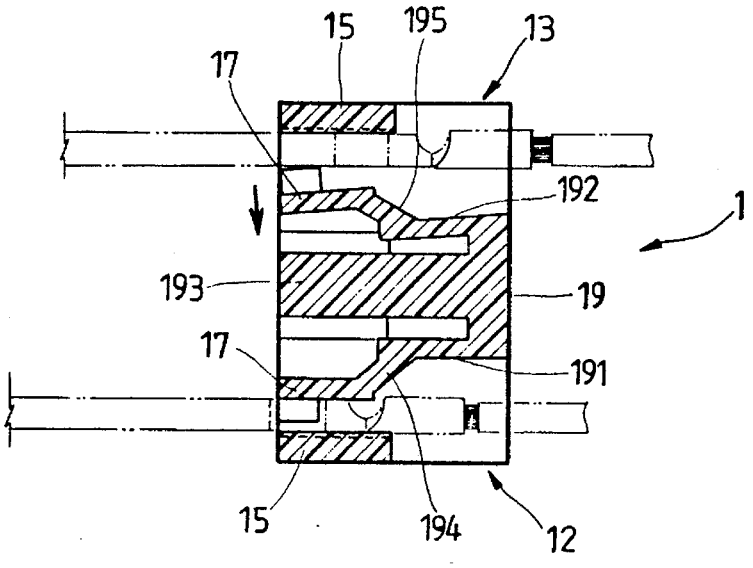
FIG. 4 is a sectional view taken along line 4—4 of FIG. 3.

Referring now to FIGS. 1, 2 and 4, further features of inner plug core 1 can be seen. The lower left and lower right insert holes 12 and 13 of the inner plug core 1 are separated by a reverse E-shaped member 19, best seen in FIG. 4. The reverse E-shaped member 19 has two lateral plates 191,192 which respectively serve as inner side walls of the respective insert holes 12 and 13, and a central support rod 193 connected with the main body of the inner plug core 1. The reverse E-shaped member 19 is thereby substantially divided into two substantially C-shaped frame member. In addition, the two lateral plates 191 and 192 of the reverse E-shaped member 19 respectively each have an outwardly extending inclined guide plate 194, 195 which are each connected with a respective one of two clip plates 17.

Referring to FIG. 2, there is shown, two parallel clip plates 15 and 17 disposed in each of the lower left and lower right insert holes 12 and 13 to define a clearance space therebetween for receipt of the respective positive and negative terminals 4 and 5 therein.

With reference to FIGS. 3 and 4, after the grounding terminal 3 and positive and negative terminals 4 and 5 are connected to power wires, the terminals 3, 4 and 5 are manually inserted into the respective insert holes 11, 12 and 13. After the grounding terminal 3 is inserted into the insert hole 11, the elliptic boss 141 of the tongue member 14 is received into the elliptic hole 31 of the grounding terminal 3 to secure the grounding terminal 3 within the insert hole 11. Also, the recesses 41, 51 of the positive and negative terminals 4 and 5 are clamped by respective projections 162 of the clip plates 17, with the terminals being captured in the clearance space defined by the recess 161 of the clip plates 17 and the projection 152 of the clip plate 15. Accordingly, when assembling the grounding terminal 3 and positive and negative terminals 4 and 5 to the inner plug core 1, the terminals are accurately and quickly inserted and stably located. In addition, the assembling procedure is accomplished with a reduced inserting force.

One of the features of the present invention resides in the C-shaped tongue member 14, wherein the right top portion of the tongue member 14 serves as a fulcrum and the top transverse plate 142 of the tongue member 14 being cantilevered to serve as a force arm. When the grounding terminal 3 is inserted into the insert hole 11, only a light force is needed to press down the elliptic boss 141 of the top transverse plate 142 of the tongue member 14. Also, the provision of the reverse E-shaped member 19 can achieve the same effect as the C-shaped tongue member 14. The two lateral plates 191 and 192 of the reverse E-shaped member 19 serve as the inner side walls of the lower left and lower right insert holes 12 and 13, respectively, and the central support rod 193 of the reverse E-shaped member 19 is connected to the main body of the inner plug core 1. The two lateral plates 191 and 192 of the reverse E-shaped member 19 each have a respective outwardly extending inclined guide plate 194, 195 and a clip plate 17 further extends from each of the guide plates 194, 195. The inclined guide plates 194 and 195 each guide a respective one of the positive and negative terminals 4, 5 into the respective insert hole 12, 13 during their insertion. Therefore, the terminals 4, 5 can be easily inserted into an insert hole 12, 13 by exerting a light force on rear ends of the respective terminal 4, 5, to facilitate the assembly procedure.

Figure 5:
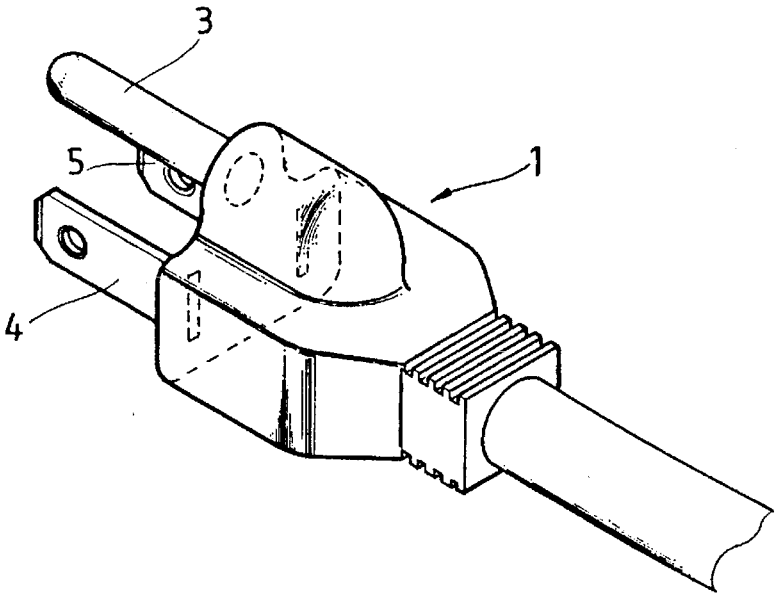
FIG. 5 shows the application of the present invention.
Figure 6:
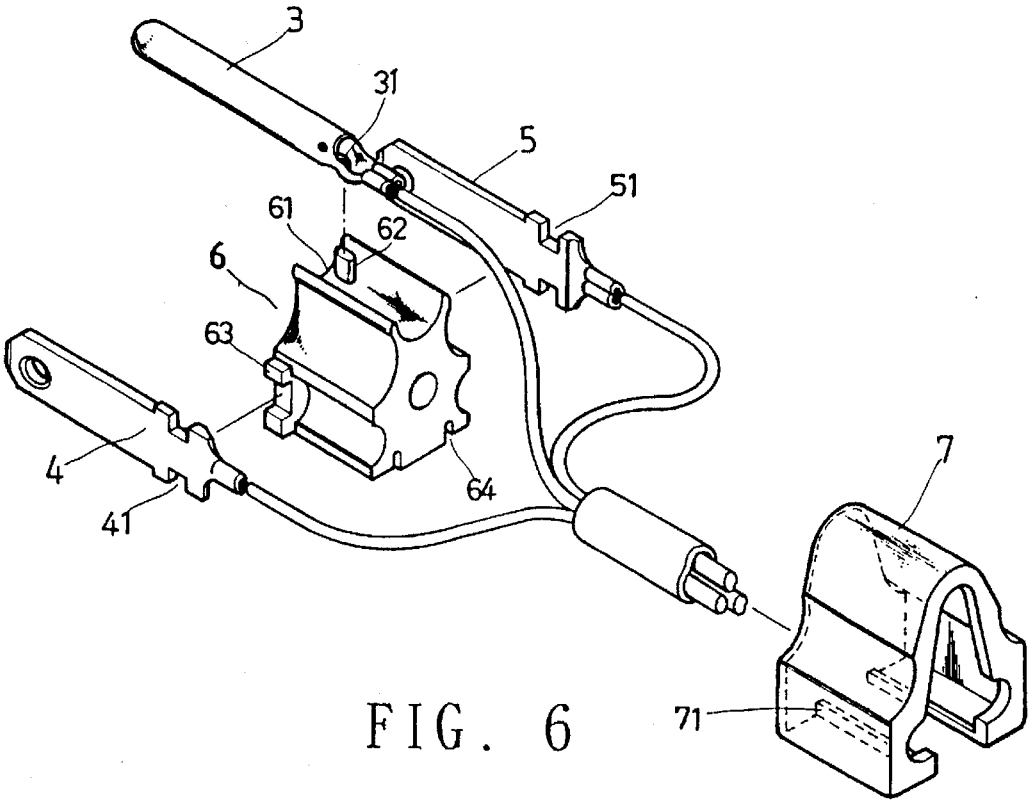
FIG. 6 is a perspective exploded view of the inner plug core of a conventional power plug; and, FIG. 7 is a perspective assembled view of a conventional power plug.
Figure 7:
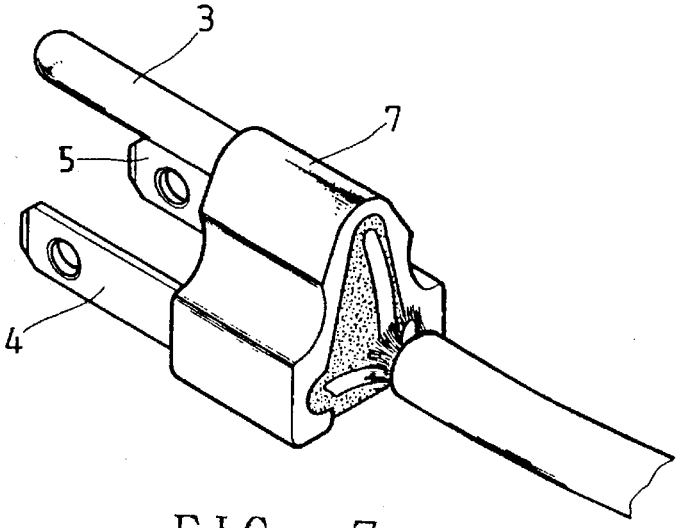

After the grounding terminal 3 and positive and negative terminals 4 and 5, which are connected to power wires, are completely inserted into the inner plug core 1, the inner plug core 1 is placed into a mold for enclosing the assembly and forming a molded power plug, as shown in FIG. 5.

In conclusion, by means of the inner plug core for a power plug of the present invention, the grounding terminal and positive and negative terminals can be easily inserted into the respective insert holes of the inner plug core with a light inserting force. Therefore, the assembly procedure of the power plug is facilitated and the manufacturing cost thereof is reduced.

It is to be understood that the above description and drawings are only used for illustrating one embodiment of the present invention, not intended to limit the scope thereof. Any variation and derivation from the above description and drawings should be included in the scope of the present invention.

What is claimed is:

1. An inner plug core for a molded power plug, comprising an integrally molded main body having three insert holes formed through a front face thereof and disposed in triangularly spaced relationship each with respect to the others for receiving electrical terminals therein, said main body including:

a. a protective shade disposed above an upper one of said three insert holes;

b. a C-shaped tongue member disposed beneath said protective shade and extending toward said front face of said main body, said tongue member having a bottom arm coupled to said main body by a triangularly shaped support plate and a cantilevered top arm, said top arm having an elliptically shaped boss formed thereon adjacent a distal end thereof;

c. a reverse E-shaped member disposed between a remaining two of said three insert holes, said reverse E-shaped member including a central support rod coupled to said main body and a pair of laterally extending plates disposed on opposing sides thereof, each of said laterally extending plates defining an inner side wall of a respective one of said two insert holes, each of said inner side walls having a centrally located and laterally extending recess formed therein and at least one projection extending transversely therefrom for engagement within a respective notch formed in an electrical terminal, each of said laterally extending plates having an inclined portion for guiding insertion of an electrical terminal into a respective one of said two insert holes; and, d. a pair of laterally extending outer plates, each of said outer plates having one end thereof coupled to said main body for defining an outer side wall of a respective one of said two insert holes, each of said outer plates having a centrally located and laterally extending projecting surface portion disposed in corresponding relation with said recess of a respective inner side wall.

* * * * *